US011319615B2

(12) United States Patent
Matsunaga et al.

(10) Patent No.: US 11,319,615 B2
(45) **Date of Patent: *May 3, 2022**

(54) COPPER ALLOY FOR ELECTRONIC AND ELECTRICAL EQUIPMENT, COPPER ALLOY PLATE STRIP FOR ELECTRONIC AND ELECTRICAL EQUIPMENT, COMPONENT FOR ELECTRONIC AND ELECTRICAL EQUIPMENT, TERMINAL, BUSBAR, AND MOVABLE PIECE FOR RELAY

(71) Applicant: MITSUBISHI MATERIALS CORPORATION, Tokyo (JP)

(72) Inventors: Hirotaka Matsunaga, Kitamoto (JP); Kazunari Maki, Saitama (JP)

(73) Assignee: MITSUBISHI MATERIALS CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/076,257

(22) PCT Filed: Mar. 29, 2017

(86) PCT No.: PCT/JP2017/012993

§ 371 (c)(1),
(2) Date: Aug. 7, 2018

(87) PCT Pub. No.: WO2017/170733

PCT Pub. Date: Oct. 5, 2017

(65) Prior Publication Data

US 2021/0017628 A1 Jan. 21, 2021

(30) Foreign Application Priority Data

Mar. 30, 2016 (JP) ..... 2016-069079
Mar. 28, 2017 (JP) ..... JP2017-063258

(51) Int. Cl.
*C22C 9/00* (2006.01)
*C21D 9/46* (2006.01)
(Continued)

(52) U.S. Cl.
CPC ..... *C22C 9/00* (2013.01); *C21D 9/46* (2013.01); *H01R 13/03* (2013.01); *H01B 1/02* (2013.01); *H01B 5/02* (2013.01)

(58) Field of Classification Search
CPC .. C22C 9/00; C21D 9/46; H01R 13/03; H01B 1/02; H01B 5/02
(Continued)

(56) References Cited

U.S. PATENT DOCUMENTS 3,677,745 A 7/1972 Finlay et al.
3,778,318 A * 12/1973 Finlay et al. ..... F28F 1/32 148/682
(Continued)

FOREIGN PATENT DOCUMENTS

CN 1574107 A 2/2005
CN 1924048 A 3/2007
(Continued)

OTHER PUBLICATIONS

English language machine translation of JP05-311283 to Suzuki et al. Generated Mar. 11, 2021. (Year: 2021).*
(Continued)

*Primary Examiner* — Brian D Walck
(74) *Attorney, Agent, or Firm* — Leason Ellis LLP

(57) ABSTRACT

A copper alloy for electronic and electrical equipment is provided, including: 0.15 mass % or greater and less than 0.35 mass % of Mg; 0.0005 mass % or greater and less than 0.01 mass % of P; and a remainder which is formed of Cu and unavoidable impurities, in which a conductivity is greater than 75% IACS, a content [Mg] (mass %) of Mg and
(Continued)

a content [P] (mass %) of P satisfy a relational expression of [Mg]+20×[P]<0.5, and a content of H is 10 mass ppm or less, a content of O is 100 mass ppm or less, a content of S is 50 mass ppm or less, and a content of C is 10 mass ppm or less.

13 Claims, 1 Drawing Sheet

(51) Int. Cl.
*H01R 13/03* (2006.01)
*H01B 1/02* (2006.01)
*H01B 5/02* (2006.01)

(58) Field of Classification Search
USPC ..... 420/469
See application file for complete search history.

(56) References Cited

U.S. PATENT DOCUMENTS

| | | | | |
|---|---|---|---|---|
| 5,486,244 | A | 1/1996 | Caron et al. | |
| 5,667,752 | A | 9/1997 | Suzuki et al. | |
| 10,128,019 | B2 | 11/2018 | Matsunaga et al. | |
| 10,157,694 | B2 | 12/2018 | Ito et al. | |
| 10,453,582 | B2 | 10/2019 | Matsunaga et al. | |
| 10,676,803 | B2 | 6/2020 | Matsunaga et al. | |
| 2002/0044881 | A1 | 4/2002 | Breedis et al. | |
| 2004/0238086 | A1 | 12/2004 | Saleh | |
| 2008/0298998 | A1 | 12/2008 | Kaneko et al. | |
| 2009/0239398 | A1 | 9/2009 | Lynch et al. | |
| 2010/0132851 | A1 | 6/2010 | Gao et al. | |
| 2010/0269963 | A1 | 10/2010 | Hirose et al. | |
| 2011/0146855 | A1 | 6/2011 | Sakurai et al. | |
| 2013/0048162 | A1 | 2/2013 | Ito et al. | |
| 2014/0193293 | A1 | 7/2014 | Shishido et al. | |
| 2014/0209221 | A1 | 7/2014 | Kumagai et al. | |
| 2014/0283962 | A1 | 9/2014 | Ito et al. | |
| 2015/0037608 | A1 | 2/2015 | Shinohara et al. | |
| 2016/0160321 | A1* | 6/2016 | Ito | C22C 9/00 439/887 |
| 2016/0201179 | A1 | 7/2016 | Miyagi et al. | |
| 2018/0040389 | A1* | 2/2018 | Matsunaga | C22F 1/08 |
| 2018/0171437 | A1* | 6/2018 | Matsunaga | H01B 1/026 |
| 2018/0187292 | A1* | 7/2018 | Matsunaga | C22C 9/00 |
| 2018/0211741 | A1 | 7/2018 | Matsunaga et al. | |
| 2019/0048449 | A1* | 2/2019 | Matsunaga | H01B 1/026 |
| 2021/0002743 | A1* | 1/2021 | Matsunaga | C22F 1/08 |
| 2021/0017628 | A1 | 1/2021 | Matsunaga | |

FOREIGN PATENT DOCUMENTS

| | | | |
|---|---|---|---|
| CN | 102108457 | A | 6/2011 |
| CN | 102177273 | A | 9/2011 |
| CN | 102203916 | A | 9/2011 |
| CN | 102753712 | A | 10/2012 |
| CN | 102892908 | A | 1/2013 |
| CN | 103502486 | A | 1/2014 |
| CN | 104822853 | A | 8/2015 |
| CN | 105369050 | A | 3/2016 |
| CN | 105392908 | A | 3/2016 |
| CN | 107208189 | A | 9/2017 |
| EP | 3348658 | A | 7/2018 |
| EP | 3438299 | A1 | 2/2019 |
| JP | 58-199835 | A | 11/1983 |
| JP | 61-284946 | A | 12/1986 |
| JP | 05-311283 | A | 11/1993 |
| JP | 07-018354 | A | 1/1995 |
| JP | 2007-056297 | A | 3/2007 |
| JP | 2009-007666 | A | 1/2009 |
| JP | 2009-228013 | A | 10/2009 |
| JP | 2010-126777 | A | 6/2010 |
| JP | 2011-174127 | A | 9/2011 |
| JP | 2011-241412 | A | 12/2011 |
| JP | 2012-007231 | A | 1/2012 |
| JP | 5045783 | B | 10/2012 |
| JP | 2013-095943 | A | 5/2013 |
| JP | 2013-100570 | A | 5/2013 |
| JP | 2013-104101 | A | 5/2013 |
| JP | 2013-204079 | A | 10/2013 |
| JP | 2013-253267 | A | 12/2013 |
| JP | 2014-025089 | A | 2/2014 |
| JP | 2014-047378 | A | 3/2014 |
| JP | 2014-114464 | A | 6/2014 |
| JP | 2015030863 | A | 2/2015 |
| JP | 2015-045083 | A | 3/2015 |
| JP | 2015-048503 | A | 3/2015 |
| JP | 2015-101773 | A | 6/2015 |
| JP | 5910790 | B | 4/2016 |
| JP | 2016047945 | A | 4/2016 |
| JP | 6156600 | B | 7/2017 |
| JP | 6187629 | B | 8/2017 |
| JP | 2017-179490 | A | 10/2017 |
| JP | 2017-179492 | A | 10/2017 |
| JP | 2017-179493 | A | 10/2017 |
| JP | 2017-179553 | A | 10/2017 |
| JP | 2017-186662 | A | 10/2017 |
| JP | 2017-186664 | A | 10/2017 |
| TW | 201339328 | A | 10/2013 |
| TW | 201807209 | A | 3/2018 |
| WO | WO-2003/076672 | A | 9/2003 |
| WO | WO-2005/028143 | A1 | 3/2005 |
| WO | WO-2012/169405 | A | 12/2012 |
| WO | WO-2013/062091 | A | 5/2013 |
| WO | WO-2013/069687 | A | 5/2013 |
| WO | WO-2013/073412 | A | 5/2013 |
| WO | WO-2013/150627 | A1 | 10/2013 |
| WO | WO-2017/043559 | A1 | 3/2017 |
| WO | WO-2017/170733 | A1 | 10/2017 |

OTHER PUBLICATIONS

English language machine translation of JP2014047378 to Aida et al . Generated Mar. 11, 2021. (Year: 2021).*

Extended European Search Report dated Nov. 19, 2019 for the corresponding European Patent Application No. 17775267.2.

International Search Report dated Jun. 27, 2017 for the corresponding PCT Application No. PCT/JP2017/012993.

Notice of Allowance dated Sep. 12, 2017 for the corresponding Japanese Patent Application No. 2017-063258.

Chinese Office Action dated Aug. 28, 2019 for the corresponding Chinese Patent Application No. 201780005496.3.

Office Action dated Aug. 28, 2019 for the related U.S. Appl. No. 15/741,148.

Office Action dated Jul. 11, 2019 for the related U.S. Appl. No. 15/737,642.

Jingpu Wang et al., "Cable Materials," *Mechanical Industry Press*, Nov. 1983, pp. 80-81.

Chinese Office Action dated Jun. 12, 2019 for the related Chinese Patent Application No. 201680008019.8.

Maki et al., "Solid-solution copper alloys with high strength and high electrical conductivity", *Scripta Materialia*, Jan. 2, 2013, pp. 777-780, vol. 68, No. 10, Elsevier, Amsterdam, NL.

Maki et al., "Supplementary information to Solid-solution copper alloys with high strength and high electrical conductivity", *Scripta Materialia*, vol. 68, No. 10, Jan. 2, 2013, pp. 777-780.

Zhu et al., "Effect of ECAP combined cold working on mechanical properties and electrical conductivity of Conform-produced Cu—Mg al", *Journal of Alloys and Compounds*, vol. 582, Aug. 14, 2013, pp. 135-140.

ASM "Casting of Copper and Copper Alloys" In: "Casting", *ASM International*, Dec. 31, 2008, pp. 1026-1048.

European Search Report dated Apr. 17, 2019 for the related European Patent Application No. 16844417.2.

European Search Report dated Apr. 18, 2019 for the related European Patent Application No. 16844438.8.

European Office Action dated Feb. 28, 2019 in related European Application No. 16844412.3.

(56) References Cited

OTHER PUBLICATIONS

Supplemental European Search Report dated Mar. 7, 2019 in related European Application No. 16844420.6.
David Chapman: "Coatings" In: "Copper for Busbars", May 31, 2014 (May 31, 2014), Copper Development Association, pp. 103-105.
Chinese Office Action dated Dec. 27, 2018 for the related Chinese Application No. 201680008019.8.
Chinese Office Action dated Nov. 27, 2018 for the related Chinese Application No. 201680032061.3.
Chinese Office Action dated Apr. 4, 2018 for the related Chinese Patent Application No. 201680008019.8.
International Search Report dated Dec. 6, 2016 for the related PCT Application No. PCT/JP2016/076387.
International Search Report dated Nov. 8, 2016 for the related PCT Application No. PCT/JP2016/076376.
International Search Report dated Nov. 8, 2016 for the related PCT Application No. PCT/JP2016/076456.
International Search Report dated Nov. 8, 2016 for the related PCT Application No. PCT/JP2016/076362.
Japanese Notice of Allowance dated May 9, 2017 for the related Japanese Patent Application No. 2016-575989.
David Chapman "High Conductivity Copper for Electrical Engineering", May 31, 1998 [Retrieved from the Internet on Jul. 2, 2018].
R. Sundberg et al., "The Cu—Mg—P system: precipitation phenomena and physical properties", *Metal Technology*, Dec. 31, 1979, pp. 230-234, vol. 6, No. 1.
Extended European Search Report dated Jul. 11, 2018 for the related European Patent Application No. 16844412.3.
International Search Report dated Jun. 27, 2017 for the related PCT Application No. PCT/JP2017/012914.
Japanese Notice of Allowance dated Sep. 12, 2017 for the related Japanese Patent Application No. 2017-063418.
Chinese Office Action dated Aug. 1, 2019 for the related Chinese Patent Application No. 201780005558.0.
Extended European Search Report dated Nov. 8, 2019 for the related European Patent Application No. 17775233.4.
Non-Final Office Action dated Nov. 18, 2020 for the related U.S. Appl. No. 16/976,351.
Non-Final Office Action dated Apr. 1, 2020 for the related U.S. Appl. No. 15/737,642.
Final Office Action dated Nov. 14, 2019 for the related U.S. Appl. No. 15/737,642.
Non-Final Office Action dated Sep. 5, 2018 for the related U.S. Appl. No. 15/543,664.
Nomura, "Technical Trends in High Performance Copper Alloy Strip for Connector and Kobe Steel's Development Strategy", *Ko741be Steel Works Engineering Reports*, Apr. 2004, pp. 2-8, vol. 54 No. 1.
Hori, et al., "Intergranular (Grain boundary) precipitation in a Cu—Mg alloy", *Journal of the Japan Copper and Brass Research Association*, 1980, pp. 115-124, vol. 19.
International Search Report dated Jan. 27, 2015 for the corresponding PCT Application No. PCT/JP2014/078031.
Japanese Office Action dated Oct. 27, 2015 for related Japanese Patent No. 2013-256310.
Taiwanese Office Action dated Nov. 9, 2015 for the related Taiwanese Patent No. 103138036.
J.R. Davis, edited, "ASM Speciality Handbook—Copper and its alloys", Aug. 2001, pp. 15, *ASM International*, Materials Park, U.S.A.
E.G. West, "Copper and its alloys", 1982, pp. 129, *Ellis Horwood Limited*, Chichester, England.
Extended European Search Report dated Jul. 17, 2017 for the related European Patent Application No. 14869335.1.
Chinese Office Action dated Apr. 14, 2017 for the related Chinese Patent Application No. 201480065514.3.
Kronberg et al., "Secondary Recrystallization in Copper" *Metals Transactions*, Aug. 1949, pp. 501-514, vol. 185.
D. G. Brandon, "The Structure of High-Angle Grain Boundaries", *Acta Metallurgica*, Nov. 1966, pp. 1479-1484, vol. 14.
International Search Report dated Jul. 2, 2019 for the related PCT International Application No. PCT/JP2019/013552.
Japanese Office Action dated Nov. 19, 2019 for the related Japanese Patent Application No. 2019-528783.
Notice of Allowance dated Feb. 5, 2020 for the related U.S. Appl. No. 15/741,148.
Office Action dated Aug. 18, 2020 for the related U.S. Appl. No. 16/076,617.
Office Action dated Feb. 24, 2021 for the related U.S. Appl. No. 16/076,617.
Korean Notice of Allowance dated Jun. 24, 2021 for the related Korean Patent Application No. 10-2018-7021014.
Chinese Office Action dated May 10, 2021 for the related Chinese Patent Application No. 201980015759.8.
European Search Report dated Oct. 21, 2021 for the related European Patent Application No. 19775874.1.
Taiwanese Office Action dated Jan. 6, 2022 for the corresponding Taiwanese Patent Application No. 108110878.

* cited by examiner

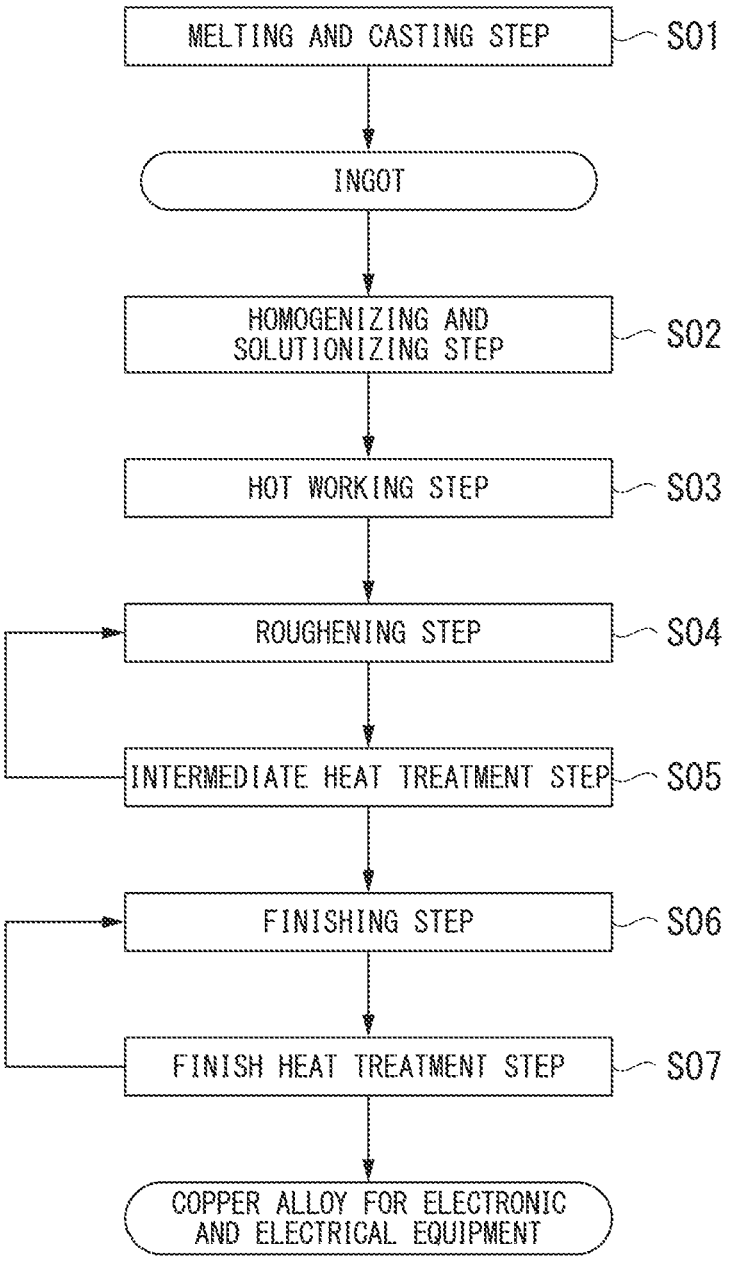
MELTING AND CASTING STEP
S01
INGOT
HOMOGENIZING AND SOLUTIONIZING STEP
S02
HOT WORKING STEP
S03
ROUGHENING STEP
S04
INTERMEDIATE HEAT TREATMENT STEP
S05
FINISHING STEP
S06
FINISH HEAT TREATMENT STEP
S07
COPPER ALLOY FOR ELECTRONIC AND ELECTRICAL EQUIPMENT

COPPER ALLOY FOR ELECTRONIC AND ELECTRICAL EQUIPMENT, COPPER ALLOY PLATE STRIP FOR ELECTRONIC AND ELECTRICAL EQUIPMENT, COMPONENT FOR ELECTRONIC AND ELECTRICAL EQUIPMENT, TERMINAL, BUSBAR, AND MOVABLE PIECE FOR RELAY

CROSS-REFERENCE TO RELATED PATENT APPLICATIONS

This application is a U.S. National Phase Application under 35 U.S.C. § 371 of International Patent Application No. PCT/JP2017/012993, filed Mar. 29, 2017, and claims the benefit of Japanese Patent Application No. 2016-069079, filed on Mar. 30, 2016, and Japanese Patent Application No. 2017-063258, filed on Mar. 28, 2017, all of which are incorporated herein by reference in their entirety. The International Application was published in Japanese on Oct. 5, 2017 as International Publication No. WO/2017/170733 under PCT Article 21(2).

FIELD OF THE INVENTION

The invention of the present application relates to a copper alloy for electronic and electrical equipment suitable for a component for electronic and electrical equipment, for example, a terminal such as a connector or a press fit, a movable piece for a relay, a lead frame, or a busbar, and a copper alloy plate strip for electronic and electrical equipment, a component for electronic and electrical equipment, a terminal, a busbar, and a movable piece for a relay formed of the copper alloy for electronic and electrical equipment.

BACKGROUND OF THE INVENTION

In the related art, as a component for electronic and electrical equipment, for example, a terminal such as a connector or a press fit, a movable piece for a relay, a lead frame, or a busbar, copper or a copper alloy with high conductivity has been used.

Here, along with miniaturization of electronic equipment, electrical equipment, or the like, miniaturization and reduction in thickness of a component for electronic and electrical equipment used for the electronic equipment, the electrical equipment, or the like have been attempted. Therefore, the material constituting the component for electronic and electrical equipment is required to have high strength or excellent bending workability. Further, a terminal such as a connector used in a high-temperature environment such as an engine room of a vehicle is required to have stress relaxation resistance.

For example, a Cu—Mg-based alloy is suggested in Japanese Unexamined Publication No. 2007-056297 and Japanese Unexamined Publication No. 2014-114464 as the material used for the terminal such as a connector or a press fit or the component for electronic and electrical equipment such as a movable piece for a relay, a lead frame, or a busbar.

Technical Problem

However, in the Cu—Mg-based alloy described in Japanese Unexamined Publication No. 2007-056297, since the content of P is in a range of 0.08 to 0.35 mass %, which is large, cold workability and bending workability are insufficient and a component for electronic and electrical equipment having a predetermined shape is unlikely to be formed.

Further, in the Cu—Mg-based alloy described in Japanese Unexamined Publication No. 2014-114464, since the content of Mg is in a range of 0.01 to 0.5 mass % and the content of P is in a range of 0.01 to 0.5 mass %, a coarse crystallized product is generated and thus cold workability and bending workability are insufficient.

In the above-described Cu—Mg-based alloy, the viscosity of a molten copper alloy is increased due to Mg. Accordingly, there is a problem in that the castability is degraded in a case where P is not added.

In Japanese Unexamined Publication No. 2007-056297 and Japanese Unexamined Publication No. 2014-114464, the content of O or the content of S is not considered. Therefore, there is a concern that defects occur during processing due to generation of inclusions formed of Mg oxide or Mg sulfide and thus the cold workability and the bending workability are degraded. Further, since the content of H is not considered, there is a concern that defects occur during processing due to the occurrence of blow-hole defects in an ingot and thus the cold workability and the bending workability are degraded. In addition, since the content of C is not considered, there is a concern that the cold workability is degraded due to defects caused by C during casting.

The present invention has been made in consideration of the above-described circumstances, and an object thereof is to provide a copper alloy for electronic and electrical equipment, a copper alloy plate strip for electronic and electrical equipment, a component for electronic and electrical equipment, a terminal, a busbar, and a movable piece for a relay with excellent conductivity, cold workability, bending workability, and castability.

SUMMARY OF THE INVENTION

Solution to Problem

As a result of intensive research conducted by the present inventors in order to solve the above-described problems, it was found that, by setting the contents of Mg and P in an alloy to be in a range of a predetermined relational expression and specifying the contents of H, O, C, and S, crystallized materials containing Mg and P and inclusions formed of Mg oxide or Mg sulfide can be reduced and the strength, the stress relaxation resistance, and the castability can be improved without degrading the cold workability and the bending workability.

The invention of the present application has been made based on the above-described findings. According to an aspect of the invention of the present application, a copper alloy for electronic and electrical equipment (hereinafter, referred to as a "copper alloy for electronic and electrical equipment of the present disclosure") is provided, including: 0.15 mass % or greater and less than 0.35 mass % of Mg; 0.0005 mass % or greater and less than 0.01 mass % of P; and a remainder which is formed of Cu and unavoidable impurities, in which a conductivity is greater than 75% IACS, a content [Mg] (mass %) of Mg and a content [P] (mass %) of P satisfy a relational expression of $[Mg]+20\times[P]<0.5$, and a content of H is 10 mass ppm or less, a content of O is 100 mass ppm or less, a content of S is 50 mass ppm or less, and a content of C is 10 mass ppm or less.

According to the copper alloy for electronic and electrical equipment with the above-described configuration, the content of Mg is 0.15 mass % or greater and less than 0.35 mass %. Therefore, by solid-dissolving Mg in a mother phase of copper, the strength and the stress relaxation resistance can be improved without significantly degrading the conductivity.

Further, since the content of P is 0.0005 mass % or greater and less than 0.01 mass %, the castability can be improved.

Further, since the content [Mg] of Mg and the content [P] of P satisfy a relational expression of $[Mg]+20\times[P]<0.5$ in terms of mass ratio, generation of a coarse crystallized material containing Mg and P can be suppressed and degradation of cold workability and bending workability can be suppressed.

Further, since the content of O is 100 mass ppm or less and the content of S is 50 mass ppm or less, inclusions formed of Mg oxide or Mg sulfide can be reduced and the occurrence of defects during processing can be suppressed. Moreover, consumption of Mg can be prevented by reacting with O and S and deterioration of mechanical characteristics can be suppressed.

Further, since the content of H is 10 mass ppm or less, the occurrence of blow-hole defects in an ingot can be suppressed and the occurrence of defects during processing can be suppressed.

In addition, since the content of C is 10 mass ppm or less, the cold workability can be ensured and the occurrence of defects during processing can be suppressed.

Further, since the conductivity is greater than 75% IACS, the alloy can be used for applications where pure copper has been used in the related art.

In the copper alloy for electronic and electrical equipment of the present disclosure, it is preferable that the content [Mg] (mass %) of Mg and the content [P] (mass %) of P satisfy a relational expression of $[Mg]/[P]\leq 400$.

In this case, the castability can be reliably improved by specifying the ratio between the content of Mg that decreases the castability and the content of P that improves the castability, as described above.

In the copper alloy for electronic and electrical equipment of the present disclosure, it is preferable that a 0.2% proof stress measured at the time of a tensile test performed in a direction orthogonal to a rolling direction is 300 MPa or greater.

In this case, since the 0.2% proof stress measured at the time of the tensile test performed in a direction orthogonal to a rolling direction is specified as described above, the copper alloy is not easily deformed and is particularly suitable as a copper alloy constituting a component for electronic and electrical equipment, for example, a terminal such as a connector or a press fit, a movable piece for a relay, a lead frame, or a busbar.

Further, in the copper alloy for electronic and electrical equipment of the present disclosure, it is preferable that a residual stress ratio is 50% or greater under conditions of 150° C. for 1000 hours.

In this case, since the residual stress ratio is specified as described above, permanent deformation can be suppressed to the minimum in a case of being used in a high-temperature environment, and a decrease in contact pressure of a connector terminal or the like can be suppressed. Therefore, the alloy can be applied as a material of a component for electronic equipment to be used in a high-temperature environment such as an engine room.

A copper alloy plate strip for electronic and electrical equipment according to another aspect of the invention of the present application (hereinafter, referred to as a "copper alloy plate strip for electronic and electrical equipment") includes the copper alloy for electronic and electrical equipment.

According to the copper alloy plate strip for electronic and electrical equipment with such a configuration, since the copper alloy plate strip is formed of the copper alloy for electronic and electrical equipment, the conductivity, the strength, the cold workability, the bending workability, and the stress relaxation resistance are excellent. Accordingly, the copper alloy plate strip is particularly suitable as a material of a component for electronic and electrical equipment, for example, a terminal such as a connector or a press fit, a movable piece for a relay, a lead frame, or a busbar.

Further, the copper alloy plate strip for electronic and electrical equipment of the invention of the present application includes a plate material and a strip formed by winding the plate material in a coil shape.

In the copper alloy plate strip for electronic and electrical equipment of the invention of the present application, it is preferable that the copper alloy plate strip includes a Sn plating layer or a Ag plating layer on a surface of the copper alloy plate strip.

In this case, since the surface of the copper alloy plate strip has a Sn plating layer or a Ag plating layer, the copper alloy plate strip is particularly suitable as a material of a component for electronic and electrical equipment, for example, a terminal such as a connector or a press fit, a movable piece for a relay, a lead frame, or a busbar. In the invention of the present application, the "Sn plating" includes pure Sn plating or Sn alloy plating and the "Ag plating" includes pure Ag plating or Ag alloy plating.

A component for electronic and electrical equipment according to another aspect of the invention of the present application (hereinafter, referred to as a "component for electronic and electrical equipment of the invention of the present application") includes the copper alloy plate strip for electronic and electrical equipment described above. Further, as the component for electronic and electrical equipment of the invention of the present application, a terminal such as a connector or a press fit, a movable piece for a relay, a lead frame, and a busbar are exemplified.

Since the component for electronic and electrical equipment with such a configuration is produced using the copper alloy plate strip for electronic and electrical equipment described above, excellent characteristics can be exhibited even in a case of miniaturization and reduction in thickness.

Further, in the component for electronic and electrical equipment of the invention of the present application, the component includes a Sn plating layer or a Ag plating layer on a surface of the component. Further, the Sn plating layer and the Ag plating layer may be formed on the copper alloy plate strip for electronic and electrical equipment in advance or may be formed after the component for electronic and electrical equipment is formed.

A terminal according to another aspect of the invention of the present application (hereinafter, referred to as a "terminal of the invention of the present application") includes the copper alloy plate strip for electronic and electrical equipment described above.

Since the terminal with such a configuration is produced using the copper alloy plate strip for electronic and electrical equipment described above, excellent characteristics can be exhibited even in a case of miniaturization and reduction in thickness.

Further, in the terminal of the invention of the present application, the terminal includes a Sn plating layer or a Ag plating layer on a surface of the terminal. Further, the Sn plating layer and the Ag plating layer may be formed on the copper alloy plate strip for electronic and electrical equipment in advance or may be formed after the terminal is formed.

A busbar according to another aspect of the invention of the present application (hereinafter, referred to as a "busbar of the invention of the present application") includes the copper alloy plate strip for electronic and electrical equipment described above.

Since the busbar with such a configuration is produced using the copper alloy plate strip for electronic and electrical equipment described above, excellent characteristics can be exhibited even in a case of miniaturization and reduction in thickness.

Further, in the busbar of the invention of the present application, the busbar includes a Sn plating layer or a Ag plating layer on a surface of the busbar. Further, the Sn plating layer and the Ag plating layer may be formed on the copper alloy plate strip for electronic and electrical equipment in advance or may be formed after the busbar is formed.

A movable piece for a relay according to another aspect of the invention of the present application (hereinafter, referred to as a "movable piece for a relay of the invention of the present application") includes the copper alloy plate strip for electronic and electrical equipment described above.

Since the movable piece for a relay with such a configuration is produced using the copper alloy plate strip for electronic and electrical equipment described above, excellent characteristics can be exhibited even in a case of miniaturization and reduction in thickness.

Further, in the movable piece for a relay of the invention of the present application, the movable piece includes a Sn plating layer or a Ag plating layer on a surface of the movable piece. Further, the Sn plating layer and the Ag plating layer may be formed on the copper alloy plate strip for electronic and electrical equipment in advance or may be formed after the movable piece for a relay is formed.

Advantageous Effects of Invention

According to the invention of the present application, it is possible to provide a copper alloy for electronic and electrical equipment, a copper alloy plate strip for electronic and electrical equipment, a component for electronic and electrical equipment, a terminal, a busbar, and a movable piece for a relay with excellent conductivity, cold workability, bending workability, and castability.

BRIEF DESCRIPTION OF THE DRAWINGS

The FIGURE is a flow chart showing a method of producing a copper alloy for electronic and electrical equipment according to the present embodiment.

DESCRIPTION OF EMBODIMENTS

Hereinafter, a copper alloy for electronic and electrical equipment according to an embodiment of the invention of the present application will be described.

The copper alloy for electronic and electrical equipment according to the present embodiment has a composition of 0.15 mass % or greater and less than 0.35 mass % of Mg; 0.0005 mass % or greater and less than 0.01 mass % of P; and the remainder formed of Cu and unavoidable impurities.

Further, in the copper alloy for electronic and electrical equipment according to the present embodiment, the conductivity is greater than 75% IACS.

Further, in the copper alloy for electronic and electrical equipment according to the present embodiment, the content [Mg] (mass %) of Mg and the content [P] (mass %) of P satisfy a relational expression of $[Mg]+20\times[P]<0.5$.

Further, in the copper alloy for electronic and electrical equipment according to the present embodiment, the content of H is 10 mass ppm or less, the content of O is 100 mass ppm or less, the content of S is 50 mass ppm or less, and the content of C is 10 mass ppm or less.

Further, in the copper alloy for electronic and electrical equipment according to the present embodiment, the content [Mg] (mass %) of Mg and the content [P] (mass %) of P satisfy a relational expression of $[Mg]/[P]\leq 400$.

Further, in the copper alloy for electronic and electrical equipment according to the present embodiment, the 0.2% proof stress measured at the time of a tensile test performed in a direction orthogonal to a rolling direction is 300 MPa or greater. In other words, in the present embodiment, a rolled material of the copper alloy for electronic and electrical equipment is used, and the 0.2% proof stress measured at the time of the tensile test performed in a direction orthogonal to the rolling direction in the final step of rolling is specified as described above.

Further, in the copper alloy for electronic and electrical equipment according to the present embodiment, the residual stress ratio is 50% or greater under conditions of 150° C. for 1000 hours.

Here, the reasons for specifying the component composition and various characteristics as described above will be described.

(Mg: 0.15 Mass % or Greater and Less Than 0.35 Mass %)

Mg is an element having a function of improving the strength and the stress relaxation resistance without significantly degrading the conductivity through solid solution in a mother phase of a copper alloy.

Here, in a case where the content of Mg is less than 0.15 mass %, there is a concern that the effects of the function are not fully achieved. Further, in a case where the content of Mg is 0.35 mass % or greater, there is a concern that the conductivity is significantly degraded, the viscosity of a molten copper alloy is increased, and the castability is degraded.

As described above, in the present embodiment, the content of Mg is set to be 0.15 mass % or greater and less than 0.35 mass %.

In order to improve the strength and the stress relaxation resistance, the lower limit of the content of Mg is set to preferably 0.16 mass % or greater and more preferably 0.17 mass % or greater. Further, in order to reliably suppress degradation of the conductivity and degradation of the castability, the upper limit of the content of Mg is set to preferably 0.30 mass % or less and more preferably 0.28 mass % or less.

(P: 0.0005 Mass % or Greater and Less Than 0.01 Mass %)

P is an element having a function of improving the castability.

Here, in a case where the content of P is less than 0.0005 mass %, there is a concern that the effects of the function are not fully achieved. Further, in a case where the content of P is 0.01 mass % or greater, there is a concern that, since a crystallized material containing Mg and P coarsens, this crystallized material serves as a starting point of fracture and cracking occurs during cold working or bend working.

As described above, in the present embodiment, the content of P is set to be 0.0005 mass % or greater and less than 0.01 mass %.

In order to reliably improve the castability, the lower limit of the content of P is set to preferably 0.0007 mass % and more preferably 0.001 mass %. Further, in order to reliably suppress generation of a coarse crystallized material, the upper limit of the content of P is set to preferably less than 0.009 mass %, more preferably less than 0.008 mass %, and preferably 0.0075 mass % or less. Further, the upper limit thereof is set to even still more preferably 0.0060 mass % or less and most preferably less than 0.0050 mass %.

($[Mg]+20\times[P]<0.5$)

In a case where P has been added, a crystallized material containing Mg and P is generated due to the coexistence of Mg and P as described above.

Here, in a case where the content [Mg] of Mg and the content [P] of P are set on a mass % basis, since the total amount of Mg and P is large and a crystallized material containing Mg and P coarsens and is distributed at a high density, cracking may easily occur during cold working or bend working in a case where $[Mg]+20\times[P]$ is 0.5 or greater.

As described above, in the present embodiment, $[Mg]+20\times[P]$ is set to less than 0.5. Further, in order to reliably suppress coarsening and densification of the crystallized material and to suppress the occurrence of cracking during the cold working and the bend working, $[Mg]+20\times[P]$ is set to preferably less than 0.48 and more preferably less than 0.46. Further, $[Mg]+20\times[P]$ is set to still more preferably less than 0.44 and most preferably less than 0.42.

($[Mg]/[P]\leq 400$)

Since Mg is an element having a function of increasing the viscosity of the molten copper alloy and decreasing the castability, it is necessary to optimize the ratio between the content of Mg and the content of P in order to reliably improve the castability.

Here, in a case where the content [Mg] of Mg and the content [P] of P are set on a mass % basis, since the content of Mg with respect to the content of P is increased, the effect of improving the castability through addition of P may be reduced in a case where $[Mg]/[P]$ is greater than 400.

As described above, in a case where P is added in the present embodiment, $[Mg]/[P]$ is set to 400 or less. In order to further improve the castability, $[Mg]/[P]$ is set to preferably 350 or less and more preferably 300 or less.

Further, in a case where $[Mg]/[P]$ is extremely small, since Mg is consumed as a crystallized material, the effect from solid solution of Mg may not be obtained. In order to suppress generation of a crystallized material containing Mg and P and to reliably improve the proof stress due to solid solution of Mg and the stress relaxation resistance, the lower limit of $[Mg]/[P]$ is set to preferably greater than 20 and more preferably greater than 25.

(H: 10 Mass ppm or Less)

H is an element that becomes water vapor by being connected with O during casting and allows blow-hole defects to occur in an ingot. Defects such as cracking during casting and swelling and peeling during rolling are caused by the blow-hole defects. It is known that the strength and the stress corrosion cracking characteristics deteriorate because the defects such as cracking, swelling, and peeling lead to stress concentration and cause fracture. Here, in a case where the content of H is greater than 10 mass ppm, the above-described blow-hole defects easily occur.

Accordingly, in the present embodiment, the content of H is specified to 10 mass ppm or less. Further, in order to further suppress the occurrence of the blow-hole defects, the content of H is set to preferably 4 mass ppm or less and more preferably 2 mass ppm or less.

The lower limit of the content of H is not particularly limited, but extreme reduction of the content of H results in an increase of production cost. Therefore, the content of H is typically 0.1 mass ppm or greater.

(O: 100 Mass ppm or Less)

O is an element that reacts with each component element in a copper alloy to form oxides. Since these oxides serve as a starting point of fracture, the cold workability is degraded and the bending workability also deteriorates. Further, in a case where the content of O is greater than 100 mass ppm, since Mg is consumed due to the reaction between O and Mg, there is a concern that the solid solution amount of Mg in a mother phase of Cu is decreased and the mechanical characteristics deteriorate.

Accordingly, in the present embodiment, the content of O is specified to 100 mass ppm or less. In the range described above, the content of O is particularly preferably 50 mass ppm or less and more preferably 20 mass ppm or less.

In addition, the lower limit of the content of O is not particularly limited, but extreme reduction of the content of O results in an increase of production cost. Therefore, the content of O is typically 0.1 mass ppm or greater.

(S: 50 Mass ppm or Less)

S is an element that is present on a crystal grain boundary in the form of an intermetallic compound or a complex sulfide. The intermetallic compound or the complex sulfide present on the grain boundary causes grain boundary cracks during hot working and working cracks. Further, since the intermetallic compound or the complex sulfide serves as a starting point of fracture, the cold workability or bend workability deteriorates. Further, since Mg is consumed due to the reaction between S and Mg, there is a concern that the solid solution amount of Mg in a mother phase of Cu is decreased and the mechanical characteristics deteriorate.

Accordingly, in the present embodiment, the content of S is specified to 50 mass ppm or less. In the range described above, the content of S is particularly preferably 40 mass ppm or less and more preferably 30 mass ppm or less.

In addition, the lower limit of the content of S is not particularly limited, but extreme reduction of the content of S results in an increase of production cost. Therefore, the content of S is typically 1 mass ppm or greater.

(C: 10 Mass ppm or Less)

C is an element that is used to coat the surface of molten metal during melting and casting for the purpose of deoxidizing the molten metal and may be unavoidably mixed. In a case where the content of C is greater than 10 mass ppm, the mixture of C during the casting is increased. The element C or a complex carbide and segregation of a solid solution of C deteriorate the cold workability.

Accordingly, in the present embodiment, the content of C is specified to 10 mass ppm or less. In the range described above, the content of C is particularly preferably 5 mass ppm or less and more preferably 1 mass ppm or less.

In addition, the lower limit of the content of C is not particularly limited, but extreme reduction of the content of C results in an increase of production cost. Therefore, the content of C is typically 0.1 mass ppm or greater.

(Unavoidable impurities: 0.1 mass % or less)

Examples of other unavoidable impurities include Ag, B, Ca, Sr, Ba, Sc, Y, rare earth elements, Ti, Zr, Hf, V, Nb, Ta, Cr, Mo, W, Mn, Re, Fe, Ru, Os, Co, Se, Te, Rh, Ir, Ni, Pd, Pt, Au, Zn, Cd, Hg, Al, Ga, In, Ge, Sn, As, Sb, Tl, Pb, Bi, Be, N, Si, and Li. Since these unavoidable elements have a function of decreasing the conductivity, the total amount thereof is set to 0.1 mass % or less.

Further, from the viewpoint that Ag, Zn, and Sn are easily mixed into copper so that the conductivity is decreased, it is preferable that the total amount of the unavoidable elements is set to less than 500 mass ppm. Particularly from the viewpoint that Sn greatly decreases the conductivity, it is preferable that the content of Sn is set to less than 50 mass ppm.

Further, from the viewpoint that Si, Cr, Ti, Zr, Fe, and Co greatly decrease the conductivity and the bending workability deteriorates due to the formation of inclusions, it is preferable that the total amount of these elements is set to less than 500 mass ppm.

(Conductivity: Greater than 75% IACS)

In the copper alloy for electronic and electrical equipment according to the present embodiment, by setting the conductivity to greater than 75% IACS, the alloy can be satisfactorily used as a component for electronic and electrical equipment, for example, a terminal such as a connector or a press fit, a movable piece for a relay, a lead frame, or a busbar.

In addition, the conductivity is set to preferably greater than 76% IACS, more preferably greater than 77% IACS, still more preferably greater than 78% IACS, and even still more preferably greater than 80% IACS.

(0.2% Proof Stress: 300 MPa or Greater)

In the copper alloy for electronic and electrical equipment according to the present embodiment, by setting the 0.2% proof stress to 300 MPa or greater, the alloy becomes particularly suitable as a material of a component for electronic and electrical equipment, for example, a terminal such as a connector or a press fit, a movable piece for a relay, a lead frame, or a busbar. Further, in the present embodiment, the 0.2% proof stress measured at the time of the tensile test performed in a direction orthogonal to the rolling direction is set to 300 MPa or greater.

Here, the 0.2% proof stress described above is set to preferably 325 MPa or greater and more preferably 350 MPa or greater.

(Residual Stress Ratio: 50% or Greater)

In the copper alloy for electronic equipment according to the present embodiment, the residual stress ratio is set to 50% or greater under conditions of 150° C. for 1000 hours as described above.

In a case where the residual stress ratio under the above-described conditions is high, permanent deformation can be suppressed to the minimum in a case of being used in a high-temperature environment, and a decrease in contact pressure can be suppressed. Therefore, the copper alloy for electronic equipment according to the present embodiment can be applied as a terminal to be used in a high-temperature environment such as the periphery of an engine room of a vehicle. In the present embodiment, the residual stress ratio measured at the time of a stress relaxation test performed in a direction orthogonal to the rolling direction is set to is set to 50% or greater under conditions of 150° C. for 1000 hours.

In addition, the residual stress ratio is set to preferably 60% or greater under conditions of 150° C. for 1000 hours and more preferably 70% or greater under conditions of 150° C. for 1000 hours.

Next, a method of producing the copper alloy for electronic and electrical equipment according to the present embodiment with such a configuration will be described with reference to the flow chart of the FIGURE.

(Melting and Casting Step S01)

First, the above-described elements are added to molten copper obtained by melting the copper raw material to adjust components, thereby producing a molten copper alloy. Further, a single element, a mother alloy, or the like can be used for addition of various elements. In addition, raw materials containing the above-described elements may be melted together with the copper raw material. Further, a recycled material or a scrap material of the present alloy may be used. Here, as the molten copper, so-called 4 NCu having a purity of 99.99 mass % or greater or so-called 5 NCu having a purity of 99.999 mass % or greater is preferably used. Particularly, in the present embodiment, since the contents of H, O, S, and C are specified as described above, raw materials with small contents of these elements are selected and used. Specifically, it is preferable to use a raw material having a H content of 0.5 mass ppm or less, an O content of 2.0 mass ppm or less, a S content of 5.0 mass ppm or less, and a C content of 1.0 mass ppm or less.

In the melting step, in order to suppress oxidation of Mg and reduce the hydrogen concentration, the holding time at the time of melting is set to the minimum by performing atmosphere melting using an inert gas atmosphere (for example, Ar gas) in which the vapor pressure of $H_2O$ is low.

Further, the molten copper alloy in which the components have been adjusted is injected into a mold to produce an ingot. In consideration of mass production, it is preferable to use a continuous casting method or a semi-continuous casting method.

Since a crystallized material containing Mg and P is formed at the time of solidification of molten metal, the size of the crystallized material can be set to be finer by increasing the solidification rate. Accordingly, the cooling rate of the molten metal is set to preferably 0.1° C./sec or greater, more preferably 0.5° C./sec or greater, and most preferably 1° C./sec or greater.

(Homogenizing and Solutionizing Step S02)

Next, a heat treatment is performed for homogenization and solutionization of the obtained ingot. Intermetallic compounds and the like containing Cu and Mg, as the main components, generated due to concentration through the segregation of Mg in the process of solidification are present in the ingot. Mg is allowed to be homogeneously diffused or solid-dissolved in a mother phase in the ingot by performing the heat treatment of heating the ingot to a temperature range of 400° C. to 900° C. for the purpose of eliminating or reducing the segregation and the intermetallic compounds. In addition, this homogenizing and solutionizing step S02 is performed in a non-oxidizing or reducing atmosphere. Moreover, the copper material heated to a temperature range of 400° C. to 900° C. is cooled to a temperature of 200° C. or lower at a cooling rate of 60° C./min or greater.

Here, in a case where the heating temperature is lower than 400° C., the solutionization becomes incomplete, and thus a large amount of intermetallic compounds containing, as the main components, Cu and Mg in the mother phase may remain. Further, in a case where the heating temperature is higher than 900° C., a part of the copper material becomes a liquid phase, and thus the structure or the surface state may become non-uniform. Therefore, the heating temperature is set to be in a range of 400° C. to 900° C. The heating temperature is set to more preferably 500° C. to 850° C. and still more preferably 520° C. to 800° C.

(Hot Working Step S03)

Hot working may be performed for the purpose of increasing efficiency of roughening and homogenizing the structure. The temperature condition in this hot working step S03 is not particularly limited, but is preferably set to be in a range of 400° C. to 900° C. According to a cooling method after the working, it is preferable that the cooling is performed to a temperature of 200° C. or lower at a cooling rate of 60° C./min or greater through water quenching or the like. Further, the working method is not particularly limited, and examples of the method which can be employed include rolling, drawing, extruding, groove rolling, forging, and pressing.

(Roughening Step S04)

In order to process in a predetermined shape, roughening is performed. Further, the temperature condition in this roughening step S04 is not particularly limited, but is set to be preferably in a range of −200° C. to 200° C., which is the range for cold or warm working, and particularly preferably room temperature in order to suppress re-crystallization or improve dimensional accuracy. The working ratio (rolling ratio) is preferably 20% or greater and more preferably 30% or greater. Further, the working method is not particularly limited, and examples of the method which can be employed include rolling, drawing, extruding, groove rolling, forging, and pressing.

(Intermediate Heat Treatment Step S05)

In order for thorough solutionization and improvement of the recrystallized structure and workability, a heat treatment is performed for the softening purpose after the roughening step S04. A method of the heat treatment is not particularly limited, and the heat treatment is performed in a non-oxidizing atmosphere or a reducing atmosphere preferably in a holding temperature range of 400° C. to 900° C. for a holding time of 10 seconds to 10 hours. Further, the cooling method after the working is not particularly limited, but it is preferable that a method in which the cooling rate for water quenching or the like is set to 200° C./min or greater is used.

Further, the roughening step S04 and the intermediate heat treatment step S05 may be repeatedly performed.

(Finishing Step S06)

In order to process the copper material after the intermediate heat treatment step S05 in a predetermined shape, finishing is performed. Further, the temperature condition in this finishing step S06 is not particularly limited, but is set to be preferably in a range of −200° C. to 200° C., which is the range for cold or warm working, and particularly preferably room temperature in order to suppress re-crystallization or softening. In addition, the working ratio is appropriately selected such that the shape of the copper material approximates the final shape, but it is preferable that the working ratio is set to 20% or greater from the viewpoint of improving the strength through work hardening in the finishing step S06. In a case of further improving the strength, the working ratio is set to more preferably 30% or greater, still more preferably 40% or greater, and most preferably 60% or greater. Further, since the bending workability deteriorates due to an increase of the working ratio, it is preferable that the working ratio is set to 99% or less.

(Finish Heat Treatment Step S07)

Next, in order to improve the stress relaxation resistance, carry out low-temperature annealing and hardening, or remove residual strain, a finish heat treatment is performed on the plastic working material obtained from the finishing step S06.

It is preferable that the heat treatment temperature is set to be in a range of 100° C. to 800° C. Further, in this finish heat treatment step S07, it is necessary to set heat treatment conditions (the temperature, the time, and the cooling rate) for the purpose of avoiding a significant decrease of the strength due to re-crystallization. For example, it is preferable that the material is held at 300° C. for 1 second to 120 seconds. This heat treatment is performed in a non-oxidizing or reducing atmosphere.

A method of performing the heat treatment is not particularly limited, but it is preferable that the heat treatment is performed using a continuous annealing furnace for a short period of time from the viewpoint of the effects of reducing the production cost.

Further, the finishing step S06 and the finish heat treatment step S07 may be repeatedly performed.

In the above-described manner, a copper alloy plate strip for electronic and electrical equipment (a plate material or a strip obtained by forming a plate material in a coil shape) according to the present embodiment is produced. Further, the plate thickness of the copper alloy plate strip for electronic and electrical equipment is greater than 0.05 mm and 3.0 mm or less and preferably greater than 0.1 mm and less than 3.0 mm. In a case where the plate thickness of the copper alloy plate strip for electronic and electrical equipment is 0.05 mm or less, the copper alloy plate strip is not suitable for use as a conductor in high current applications. In a case where the plate thickness is greater than 3.0 mm, it is difficult to carry out press punching.

The copper alloy plate strip for electronic and electrical equipment according to the present embodiment may be used as a component for electronic and electrical equipment as it is, but a Sn plating layer or a Ag plating layer having a film thickness of 0.1 to 100 μm may be formed on one or both plate surfaces. At this time, it is preferable that the plate thickness of the copper alloy plate strip for electronic and electrical equipment is set to 10 to 1000 times the thickness of the plating layer.

Using the copper alloy for electronic and electrical equipment (the copper alloy plate strip for electronic and electrical equipment) according to the present embodiment as a material, for example, a component for electronic and electrical equipment, for example, a terminal such as a connector or a press fit, a movable piece for a relay, a lead frame, or a busbar is formed by performing punching or bending on the material.

According to the copper alloy for electronic and electrical equipment of the present embodiment with the above-described configuration, the content of Mg is 0.15 mass % or greater and less than 0.35 mass %. Therefore, by solid-dissolving Mg in a mother phase of copper, the strength and the stress relaxation resistance can be improved without significantly degrading the conductivity.

Further, in the copper alloy for electronic and electrical equipment according to the present embodiment, since the content of P is 0.0005 mass % or greater and less than 0.01 mass %, the viscosity of the molten copper alloy can be decreased so that the castability can be improved.

Further, in the copper alloy for electronic and electrical equipment according to the present embodiment, since the conductivity is greater than 75% IACS, the copper alloy can be used for applications requiring high conductivity.

Further, since the content [Mg] (mass %) of Mg and the content [P] (mass %) of P satisfy a relational expression of $[Mg]+20\times[P]<0.5$, generation of a coarse crystallized material containing Mg and P can be suppressed.

In addition, since the content of O is 100 mass ppm or less and the content of S is 50 mass ppm or less, inclusions formed of Mg oxide and Mg sulfide can be reduced.

Further, since the content of H is 10 mass ppm or less, the occurrence of blow-hole defects in an ingot can be suppressed.

Further, since the content of C is 10 mass ppm or less, the cold workability can be ensured.

As described above, the occurrence of defects at the time of working can be suppressed so that the cold workability and the bending workability can be remarkably improved.

In the copper alloy for electronic and electrical equipment according to the present embodiment, since the content [Mg] (mass %) of Mg and the content [P] (mass %) of P satisfy a relational expression of [Mg]/[P]≤400, the ratio between the content of Mg that degrades the castability and the content of P that improves the castability is optimized, the viscosity of the molten copper alloy can be decreased due to the effects of addition of P, and the castability can be reliably improved.

In the copper alloy for electronic and electrical equipment according to the present embodiment, since the 0.2% proof stress is 300 MPa or greater and the residual stress ratio is 50% or greater under conditions of 150° C. for 1000 hours, the strength and the stress relaxation resistance are excellent. Therefore, the copper alloy is particularly suitable as a material of a component for electronic and electrical equipment, for example, a terminal such as a connector or a press fit, a movable piece for a relay, a lead frame, or a busbar.

Since the copper alloy plate strip for electronic and electrical equipment according to the present embodiment is formed of the copper alloy for electronic and electrical equipment described above, a component for electronic and electrical equipment, for example, a terminal such as a connector or a press fit, a movable piece for a relay, a lead frame, or a busbar can be produced by performing bending working or the like on this copper alloy plate strip for electronic and electrical equipment.

Further, in a case where a Sn plating layer or a Ag plating layer is formed on the surface of the copper alloy plate strip, the plate strip is particularly suitable as a material of a component for electronic and electrical equipment, for example, a terminal such as a connector or a press fit, a movable piece for a relay, a lead frame, or a busbar.

Further, since the component for electronic and electrical equipment (a terminal such as a connector or a press fit, a movable piece for a relay, a lead frame, or a busbar) according to the present embodiment is formed of the copper alloy for electronic and electrical equipment described above, excellent characteristics can be exhibited even in a case of miniaturization and reduction in thickness.

Hereinbefore, the copper alloy for electronic and electrical equipment, the copper alloy plate strip for electronic and electrical equipment, and the component for electronic and electrical equipment (such as a terminal or a busbar) according to the embodiment of the invention of the present application have been described, but the invention of the present application is not limited thereto and can be appropriately changed within the range not departing from the technical ideas of the invention.

For example, in the above-described embodiment, an example of the method of producing the copper alloy for electronic and electrical equipment has been described, but the method of producing the copper alloy for electronic and electrical equipment is not limited to the description of the embodiment, and the copper alloy may be produced by appropriately selecting a production method of the related art.

EXAMPLES

Hereinafter, results of a verification test conducted to verify the effects of the invention of the present application will be described.

Selected copper having a H content of 0.1 mass ppm or less, an O content of 1.0 mass ppm or less, a S content of 1.0 mass ppm or less, a C content of 0.3 mass ppm or less, and a Cu purity of 99.99 mass % or greater was prepared as a raw material, a high-purity alumina crucible was charged with the copper, and the copper was melted in a high-purity Ar gas (a dew point of −80° C. or lower) atmosphere using a high-frequency melting furnace. In a case where various elements were added and H and O were introduced into the molten copper alloy, an Ar—$N_2$—$H_2$ and Ar—$O_2$ mixed gas atmosphere was prepared as the atmosphere at the time of melting using high-purity Ar gas (a dew point of −80° C. or lower), high-purity $N_2$ gas (a dew point of −80° C. or lower), high-purity $O_2$ gas (a dew point of −80° C. or lower), and high-purity $H_2$ gas (a dew point of −80° C. or lower). In a case where C was introduced thereinto, the surface of the molten metal during melting was coated with C particles so that C was brought into contact with the molten metal. Further, in a case where S was introduced thereinto, S was directly added thereto. Further, a raw material having a magnesium purity of 99.99 mass % or greater was used as the raw material of Mg. In this manner, the molten alloy with the component composition listed in Tables 1 and 2 was smelted and poured into a mold to produce an ingot. Further, a carbon mold was used in Example 11 of the present invention, a heat insulating material (isowool) mold was used in Example 28 of the present invention, and a copper alloy mold having a water cooling function was used in Examples 1 to 10, 12 to 27, and 29 to 37 and Comparative Examples 1 to 11 as a casting mold. Further, the size of an ingot was set to have a thickness of approximately 20 mm, a width of approximately 200 mm, and a length of approximately 300 mm.

The vicinity of the casting surface was chamfered from the obtained ingot such that a block having a size of 16 mm×200 mm×100 mm was cut out.

This block was heated for 4 hours under the temperature conditions listed in Tables 3 and 4 in an Ar gas atmosphere and was subjected to a homogenizing and solutionizing treatment.

The copper material which had been subjected to a heat treatment was appropriately cut to have a shape suitable as the final shape and surface grinding was performed. Next, rough rolling was performed at room temperature and a rolling ratio listed in Tables 3 and 4.

Further, the obtained strip was subjected to an intermediate heat treatment under the conditions listed in Tables 3 and 4 in an Ar gas atmosphere. Thereafter, water quenching was performed.

Next, finish rolling was performed at a rolling ratio listed in Tables 3 and 4 so that a thin plate having a thickness of 0.5 mm and a width of approximately 200 mm was produced. At the time of the finish rolling, cold rolling was performed after the surface thereof was coated with rolling oil.

Further, a finish heat treatment was performed in an Ar atmosphere under conditions listed in Tables 3 and 4 after the finish rolling, and then water quenching was performed to prepare a thin plate for evaluating characteristics.

(Component Composition)

The components were analyzed using the thin plate for evaluating characteristics obtained in the above-described manner. At this time, Mg and P were analyzed according to inductively coupled plasma atomic emission spectrophotometry. Further, H was analyzed according to a thermal conductivity method, and O, S, and C were analyzed according to an infrared absorption method.

(Castability)

The presence of surface roughening during the above-described casting was observed for evaluation of the castability. A case where surface roughening was not visually found at all or hardly found was evaluated as A, a case where small surface roughening with a depth of less than 1 mm was generated was evaluated as B, and a case where surface roughening with a depth of 1 mm or greater and less than 2 mm was generated was evaluated as C. Further, a case where surface roughening with a depth of 2 mm or greater was generated was evaluated as D, and the evaluation was stopped in this case. The evaluation results are listed in Tables 5 and 6.

The depth of the surface roughening indicates the depth of surface roughening formed toward the central portion from an end portion of an ingot.

(Mechanical Characteristics)

No. 13B test pieces specified in JIS Z 2241 were collected from each strip for evaluating characteristics and the 0.2% proof stress was measured according to the offset method in JIS Z 2241. Further, the test pieces were collected in a direction orthogonal to the rolling direction. The evaluation results are listed in Tables 5 and 6.

(Breakage Number in Tensile Test)

The measurement was performed such that the tensile test was performed ten times using the above-described No. 13B test pieces, and the number of times that the tensile test pieces were broken in an elastic region before the 0.2% proof stress was counted was set as the breakage number of the tensile test. The evaluation results are listed in Tables 5 and 6.

Further, the elastic region indicates a region that satisfies a linear relationship in a stress-strain curve. As this breakage number becomes larger, the workability is degraded due to inclusions.

(Conductivity)

Test pieces having a width of 10 mm and a length of 150 mm were collected from each strip for evaluating characteristics and the electric resistance was calculated according to a 4-terminal method. Further, the dimension of each test piece was measured using a micrometer and the volume of the test piece was calculated. In addition, the conductivity was calculated from the measured electric resistance and volume. Further, the test pieces were collected such that the longitudinal directions thereof were perpendicular to the rolling direction of each strip for evaluating characteristics. The evaluation results are listed in Tables 5 and 6.

(Stress Relaxation Resistance)

A stress relaxation resistance test was carried out by loading stress according to a method in conformity with a cantilever screw type in Japan Elongated Copper Association Technical Standard JCBA-T309:2004 and measuring the residual stress ratio after storage at a temperature of 150° C. for 1000 hours.

According to the test method, test pieces (width of 10 mm) were collected in a direction orthogonal to the rolling direction from each strip for evaluating characteristics, the initial deflection displacement was set to 2 mm such that the maximum surface stress of each test piece was 80% of the proof stress, and the span length was adjusted. The maximum surface stress was determined according to the following equation.

$$\text{Maximum surface stress (MPa)} = 1.5Et\delta_o/L_s^2$$

Here, other conditions are as follows.

E: Young's modulus (MPa)

t: thickness of sample (t=0.5 mm)

$\delta_0$: initial deflection displacement (2 mm)

$L_2$: span length (mm)

The residual stress ratio was measured based on the bending habit after storage at a temperature of 150° C. for 1000 hours and the stress relaxation resistance was evaluated. Further, the residual stress ratio was calculated using the following equation.

$$\text{Residual stress ratio (\%)} = (1-\delta_t/\delta_0)\times 100$$

Here, the conditions are as follows.

δt: permanent deflection displacement (mm) after storage at 150° C. for 1000 hours–permanent deflection displacement (mm) after storage at room temperature for 24 hours $\delta_0$: initial deflection displacement (mm)

(Bending Workability)

Bend working was performed in conformity with a 4 test method in Japan Elongated Copper Association Technical Standard JCBA-T307:2007. A plurality of test pieces having a width of 10 mm and a length of 30 mm were collected from each thin plate for evaluating characteristics such that the bending axis was in a direction orthogonal to the rolling direction. A W bending test was performed using a jig in which the bending angle was set to 90 degrees, and the bending radius was set to 1.0 mm (R/t=2) in a case where the finish rolling ratio was greater than 85% and set to 0.5 mm (R/t=1) in a case where the finish rolling ratio was 85% or less.

Determination was made such that a case where the outer peripheral portion of a bent portion was visually observed and cracks were found was evaluated as "C", a case where large wrinkles were observed was evaluated as B, and a case where breakage, fine cracks, or large wrinkles were not found was evaluated as A. Further, A and B were determined as acceptable bending workability. The evaluation results are listed in Tables 5 and 6.

TABLE 1

| | | Mg | P | Impurities (mass ppm) | | | | | [Mg] + | |
|---|---|---|---|---|---|---|---|---|---|---|
| | | (mass %) | (mass %) | H | O | S | C | Cu | 20 × [P] | [Mg]/[P] |
| Examples of the present invention | 1 | 0.15 | 0.0012 | 0.3 | 3 | 5 | 0.6 | Remainder | 0.17 | 125 |
| | 2 | 0.16 | 0.0088 | 0.5 | 2 | 4 | 0.5 | Remainder | 0.34 | 18 |
| | 3 | 0.17 | 0.0044 | 0.4 | 4 | 5 | 0.5 | Remainder | 0.26 | 39 |
| | 4 | 0.18 | 0.0084 | 0.6 | 3 | 6 | 0.6 | Remainder | 0.35 | 21 |
| | 5 | 0.20 | 0.0009 | 0.3 | 4 | 5 | 0.7 | Remainder | 0.22 | 222 |
| | 6 | 0.21 | 0.0080 | 0.6 | 4 | 5 | 0.8 | Remainder | 0.37 | 26 |
| | 7 | 0.25 | 0.0016 | 0.5 | 5 | 4 | 0.6 | Remainder | 0.28 | 156 |
| | 8 | 0.25 | 0.0018 | 0.4 | 6 | 5 | 0.8 | Remainder | 0.29 | 139 |

TABLE 1-continued

| | Mg (mass %) | P (mass %) | Impurities (mass ppm) H | O | S | C | Cu | [Mg] + 20 × [P] | [Mg]/[P] |
|---|---|---|---|---|---|---|---|---|---|
| 9 | 0.26 | 0.0013 | 0.3 | 3 | 5 | 0.5 | Remainder | 0.29 | 200 |
| 10 | 0.27 | 0.0096 | 0.5 | 4 | 4 | 0.4 | Remainder | 0.46 | 28 |
| 11 | 0.27 | 0.0007 | 0.5 | 5 | 5 | 0.5 | Remainder | 0.28 | 386 |
| 12 | 0.21 | 0.0005 | 0.3 | 6 | 5 | 0.5 | Remainder | 0.22 | 420 |
| 13 | 0.21 | 0.0061 | 9.7 | 6 | 5 | 0.6 | Remainder | 0.33 | 34 |
| 14 | 0.25 | 0.0051 | 3.8 | 6 | 6 | 0.6 | Remainder | 0.35 | 49 |
| 15 | 0.29 | 0.0041 | 0.8 | 96 | 6 | 0.5 | Remainder | 0.37 | 71 |
| 16 | 0.28 | 0.0055 | 0.7 | 48 | 6 | 0.5 | Remainder | 0.39 | 51 |
| 17 | 0.27 | 0.0028 | 0.5 | 6 | 47 | 0.6 | Remainder | 0.33 | 96 |
| 18 | 0.28 | 0.0072 | 0.5 | 7 | 38 | 0.7 | Remainder | 0.42 | 39 |
| 19 | 0.21 | 0.0071 | 0.6 | 3 | 5 | 9.7 | Remainder | 0.35 | 30 |
| 20 | 0.22 | 0.0045 | 0.6 | 2 | 5 | 4.9 | Remainder | 0.31 | 49 |
| 21 | 0.26 | 0.0098 | 0.3 | 6 | 6 | 0.5 | Remainder | 0.46 | 27 |
| 22 | 0.25 | 0.0089 | 0.3 | 6 | 5 | 0.6 | Remainder | 0.43 | 28 |
| 23 | 0.26 | 0.0073 | 0.4 | 3 | 6 | 0.7 | Remainder | 0.41 | 36 |
| 24 | 0.25 | 0.0078 | 0.5 | 5 | 6 | 0.5 | Remainder | 0.41 | 32 |
| 25 | 0.30 | 0.0094 | 0.5 | 5 | 5 | 0.5 | Remainder | 0.49 | 32 |
| 26 | 0.32 | 0.0084 | 0.3 | 4 | 4 | 0.7 | Remainder | 0.49 | 38 |
| 27 | 0.31 | 0.0009 | 0.6 | 6 | 6 | 0.4 | Remainder | 0.33 | 344 |
| 28 | 0.33 | 0.0009 | 0.6 | 7 | 5 | 0.6 | Remainder | 0.35 | 367 |
| 29 | 0.34 | 0.0075 | 0.7 | 3 | 5 | 0.6 | Remainder | 0.49 | 45 |
| 30 | 0.34 | 0.0021 | 0.8 | 4 | 6 | 0.6 | Remainder | 0.38 | 162 |
| 31 | 0.15 | 0.0012 | 0.4 | 3 | 4 | 0.5 | Remainder | 0.17 | 125 |
| 32 | 0.17 | 0.0071 | 0.5 | 2 | 5 | 0.6 | Remainder | 0.31 | 24 |
| 33 | 0.22 | 0.0015 | 0.4 | 3 | 6 | 0.6 | Remainder | 0.25 | 147 |
| 34 | 0.25 | 0.0021 | 0.6 | 3 | 5 | 0.5 | Remainder | 0.29 | 119 |
| 35 | 0.26 | 0.0032 | 0.5 | 17 | 8 | 0.7 | Remainder | 0.32 | 81 |
| 36 | 0.26 | 0.0052 | 0.4 | 17 | 9 | 0.8 | Remainder | 0.36 | 50 |
| 37 | 0.26 | 0.0061 | 0.5 | 16 | 8 | 0.7 | Remainder | 0.38 | 43 |

TABLE 2

| | | Mg (mass %) | P (mass %) | Impurities (mass ppm) H | O | S | C | Cu | [Mg] + 20 × [P] | [Mg]/[P] |
|---|---|---|---|---|---|---|---|---|---|---|
| Comparative examples | 1 | 0.03 | 0.0011 | 0.3 | 3 | 3 | 0.6 | Remainder | 0.05 | 27 |
| | 2 | 0.46 | 0.0015 | 0.6 | 5 | 5 | 0.6 | Remainder | 0.49 | 307 |
| | 3 | 0.33 | 0.0989 | 0.4 | 4 | 4 | 0.7 | Remainder | 2.31 | 3 |
| | 4 | 0.35 | 0.0102 | 0.5 | 5 | 6 | 0.5 | Remainder | 0.55 | 34 |
| | 5 | 0.43 | 0.0063 | 0.8 | 6 | 5 | 0.7 | Remainder | 0.56 | 68 |
| | 6 | 0.30 | 0.0125 | 0.4 | 3 | 4 | 0.6 | Remainder | 0.55 | 24 |
| | 7 | 0.26 | 0.0053 | 51.0 | 8 | 5 | 3.3 | Remainder | 0.37 | 49 |
| | 8 | 0.25 | 0.0052 | 0.8 | 334 | 6 | 2.6 | Remainder | 0.35 | 48 |
| | 9 | 0.27 | 0.0066 | 0.7 | 4 | 163 | 1.9 | Remainder | 0.40 | 41 |
| | 10 | 0.26 | 0.0072 | 0.7 | 5 | 5 | 22.0 | Remainder | 0.40 | 36 |
| | 11 | 0.26 | 0.0011 | 0.5 | 3 | 4 | 21.0 | Remainder | 0.28 | 236 |

TABLE 3

| | | Casting Cooling rate (° C./sec) | Homogenizing/ solutionizing Temperature (° C) | Rough rolling Rolling ratio (%) | Intermediate heat treatment Temperature (° C.) | Time (h) | Finish rolling Rolling ratio (%) | Finish heat treatment Temperature (° C.) | Time (sec) |
|---|---|---|---|---|---|---|---|---|---|
| Examples of the present invention | 1 | 10 | 500 | 80 | 425 | 2 | 60 | 325 | 60 |
| | 2 | 10 | 500 | 80 | 450 | 2 | 40 | 350 | 60 |
| | 3 | 10 | 500 | 75 | 450 | 1 | 70 | 275 | 60 |
| | 4 | 10 | 600 | 80 | 475 | 2 | 35 | 350 | 60 |
| | 5 | 10 | 650 | 75 | 475 | 1 | 60 | 350 | 60 |
| | 6 | 10 | 650 | 90 | 450 | 1 | 60 | 300 | 60 |
| | 7 | 10 | 700 | 85 | 475 | 1.5 | 40 | 350 | 60 |
| | 8 | 10 | 700 | 80 | 500 | 1 | 60 | 350 | 60 |
| | 9 | 10 | 700 | 60 | 500 | 1 | 85 | 350 | 60 |
| | 10 | 10 | 700 | 50 | 500 | 2 | 75 | 325 | 300 |
| | 11 | 0.8 | 700 | 60 | 500 | 1.5 | 65 | 350 | 60 |

TABLE 3-continued

| | Casting Cooling rate (° C./sec) | Homogenizing/ solutionizing Temperature (° C) | Rough rolling Rolling ratio (%) | Intermediate heat treatment Temperature (° C.) | Intermediate heat treatment Time (h) | Finish rolling Rolling ratio (%) | Finish heat treatment Temperature (° C.) | Finish heat treatment Time (sec) |
|---|---|---|---|---|---|---|---|---|
| 12 | 10 | 700 | 75 | 450 | 1 | 60 | 325 | 60 |
| 13 | 10 | 700 | 60 | 475 | 1 | 50 | 300 | 60 |
| 14 | 10 | 700 | 65 | 450 | 3 | 60 | 300 | 60 |
| 15 | 10 | 700 | 60 | 500 | 1 | 60 | 325 | 60 |
| 16 | 10 | 700 | 55 | 450 | 1.5 | 50 | 350 | 60 |
| 17 | 10 | 700 | 50 | 475 | 2 | 60 | 300 | 60 |
| 18 | 10 | 700 | 55 | 500 | 1 | 50 | 325 | 60 |
| 19 | 10 | 700 | 55 | 450 | 2 | 60 | 300 | 300 |
| 20 | 10 | 700 | 50 | 500 | 1 | 50 | 350 | 60 |
| 21 | 10 | 700 | 50 | 500 | 1 | 50 | 300 | 60 |
| 22 | 10 | 700 | 60 | 475 | 2 | 35 | 300 | 60 |
| 23 | 10 | 700 | 55 | 500 | 1 | 70 | 350 | 60 |
| 24 | 10 | 700 | 60 | 475 | 3 | 75 | 300 | 60 |
| 25 | 10 | 700 | 50 | 525 | 1 | 60 | 325 | 60 |
| 26 | 10 | 700 | 50 | 550 | 1 | 60 | 300 | 60 |
| 27 | 10 | 700 | 60 | 500 | 2 | 60 | 350 | 60 |
| 28 | 0.4 | 700 | 75 | 500 | 1 | 65 | 300 | 60 |
| 29 | 10 | 715 | 50 | 525 | 1.5 | 60 | 350 | 120 |
| 30 | 10 | 715 | 65 | 500 | 2 | 75 | 325 | 60 |
| 31 | 10 | 500 | 60 | 425 | 2 | 90 | 325 | 60 |
| 32 | 10 | 500 | 65 | 450 | 1 | 90 | 325 | 60 |
| 33 | 10 | 600 | 45 | 450 | 5 | 92 | 350 | 60 |
| 34 | 10 | 650 | 45 | 500 | 1 | 94 | 300 | 60 |
| 35 | 10 | 650 | 50 | 500 | 5 | 80 | 350 | 60 |
| 36 | 10 | 650 | 50 | 500 | 5 | 80 | 350 | 60 |
| 37 | 10 | 650 | 50 | 500 | 5 | 80 | 350 | 60 |

TABLE 4

| | | Casting Cooling rate (° C./sec) | Homogenizing/ solutionizing Temperature (° C.) | Rough rolling Rolling ratio (%) | Intermediate heat treatment Temperature (° C.) | Intermediate heat treatment Time (h) | Finish rolling Rolling ratio (%) | Finish heat treatment Temperature (° C./sec) | Finish heat treatment Time (sec) |
|---|---|---|---|---|---|---|---|---|---|
| Comparative examples | 1 | 10 | 500 | 70 | 400 | 1 | 40 | 275 | 60 |
| | 2 | 10 | 715 | 70 | 550 | 1.5 | 60 | 350 | 60 |
| | 3 | 10 | 700 | Edge cracking largely occurred in rough rolling step and subsequent steps were stopped | | | | | |
| | 4 | 10 | 700 | Edge cracking largely occurred in rough rolling step and subsequent steps were stopped | | | | | |
| | 5 | 10 | 700 | Edge cracking largely occurred in rough rolling step and subsequent steps were stopped | | | | | |
| | 6 | 10 | 700 | Edge cracking largely occurred in rough rolling step and subsequent steps were stopped | | | | | |
| | 7 | 10 | 700 | Edge cracking largely occurred in rough rolling step and subsequent steps were stopped | | | | | |
| | 8 | 10 | 700 | 50 | 500 | 2 | 40 | 300 | 120 |
| | 9 | 10 | 700 | 50 | 500 | 1.5 | 40 | 300 | 60 |
| | 10 | 10 | 700 | 50 | 500 | 1 | 50 | 300 | 60 |
| | 11 | 10 | 650 | 20 | 475 | 3 | 96 | 350 | 60 |

TABLE 5

| | | Castability | 0.2% proof stress (MPa) | Breakage number in tensile test (times/10) | Conductivity (% IACS) | Residual stress ratio (%) | Bending workability |
|---|---|---|---|---|---|---|---|
| Examples of the present invention | 1 | A | 341 | 0 | 88.4 | 65.0 | A |
| | 2 | A | 320 | 0 | 87.6 | 68.0 | A |
| | 3 | A | 402 | 0 | 87.2 | 52.0 | A |
| | 4 | A | 304 | 0 | 86.5 | 72.0 | A |
| | 5 | B | 382 | 0 | 85.3 | 76.0 | A |
| | 6 | A | 439 | 0 | 84.6 | 66.0 | A |

TABLE 5-continued

| | Castability | 0.2% proof stress (MPa) | Breakage number in tensile test (times/10) | Conductivity (% IACS) | Residual stress ratio (%) | Bending workability |
|---|---|---|---|---|---|---|
| 7 | A | 353 | 0 | 82.3 | 85.0 | A |
| 8 | A | 402 | 0 | 82.1 | 84.0 | A |
| 9 | A | 459 | 0 | 81.8 | 84.0 | A |
| 10 | A | 441 | 0 | 80.7 | 85.0 | B |
| 11 | B | 409 | 0 | 81.3 | 85.0 | A |
| 12 | B | 414 | 0 | 84.8 | 74.0 | A |
| 13 | A | 375 | 1 | 84.6 | 67.0 | B |
| 14 | A | 437 | 0 | 82.1 | 71.0 | B |
| 15 | A | 410 | 0 | 80.5 | 72.0 | B |
| 16 | A | 396 | 0 | 80.1 | 79.0 | B |
| 17 | A | 434 | 0 | 80.9 | 70.0 | B |
| 18 | A | 396 | 0 | 80.2 | 73.0 | B |
| 19 | A | 408 | 1 | 84.2 | 70.0 | B |
| 20 | A | 352 | 0 | 83.7 | 81.0 | B |
| 21 | A | 405 | 0 | 81.2 | 72.0 | B |
| 22 | A | 367 | 0 | 84.3 | 73.0 | B |
| 23 | A | 418 | 0 | 81.3 | 81.0 | A |
| 24 | A | 462 | 0 | 82.0 | 73.0 | A |
| 25 | A | 430 | 0 | 78.8 | 77.0 | B |
| 26 | A | 444 | 0 | 77.2 | 80.0 | B |
| 27 | B | 419 | 0 | 77.8 | 84.0 | A |
| 28 | B | 464 | 0 | 76.7 | 74.0 | A |
| 29 | A | 439 | 0 | 75.8 | 83.0 | B |
| 30 | A | 469 | 0 | 75.3 | 78.0 | A |
| 31 | A | 462 | 0 | 87.0 | 53.0 | A |
| 32 | A | 484 | 0 | 85.8 | 64.0 | A |
| 33 | A | 501 | 0 | 82.5 | 78.0 | A |
| 34 | A | 551 | 1 | 80.4 | 53.0 | A |
| 35 | A | 445 | 0 | 82.0 | 80.0 | A |
| 36 | A | 441 | 0 | 82.1 | 78.0 | B |
| 37 | A | 436 | 1 | 82.3 | 77.0 | B |

TABLE 6

| | | Castability | 0.2% proof stress (MPa) | Breakage number in tensile test (times/10) | Conductivity (% IACS) | Residual stress ratio (%) | Bending workability |
|---|---|---|---|---|---|---|---|
| Comparative Example | 1 | A | 272 | 0 | 96.9 | 24.0 | A |
| | 2 | A | 458 | 0 | 70.2 | 85.0 | B |
| | 3 | A | Edge cracking largely occurred in rough rolling step and subsequent steps were stopped | | | | |
| | 4 | A | Edge cracking largely occurred in rough rolling step and subsequent steps were stopped | | | | |
| | 5 | A | Edge cracking largely occurred in rough rolling step and subsequent steps were stopped | | | | |
| | 6 | A | Edge cracking largely occurred in rough rolling step and subsequent steps were stopped | | | | |
| | 7 | A | Edge cracking largely occurred in rough rolling step and subsequent steps were stopped | | | | |
| | 8 | A | 369 | 8 | 82.6 | 72.0 | C |
| | 9 | A | 372 | 8 | 80.6 | 71.0 | C |
| | 10 | A | 397 | 6 | 81.2 | 72.0 | C |
| | 11 | B | 533 | 7 | 80.1 | 64.0 | C |

In Comparative Example 1, the content of Mg was smaller than the ratio of the invention of the present application (0.15 mass % or greater and less than 0.35 mass %), the 0.2% proof stress was low, and the strength was insufficient.

In Comparative Example 2, the content of Mg was larger than the range of the invention of the present application (0.15 mass % or greater and less than 0.35 mass %), and the conductivity was low.

In Comparative Example 3, since the content of P was larger than the range of the invention of the present application (0.0005 mass % or greater and less than 0.01 mass %) and edge cracking largely occurred in rough rolling, the subsequent evaluation was stopped.

In Comparative Examples 4 to 6, since [Mg]+20×[P] was greater than 0.5 and edge cracking largely occurred in rough rolling, the subsequent evaluation was stopped.

In Comparative Example 7, since the content of H was larger than the range of the invention of the present application (10 mass ppm or less) and edge cracking largely occurred in rough rolling, the subsequent evaluation was stopped.

In Comparative Example 8, the content of O was larger than the range of the invention of the present application (100 mass ppm or less). As a result of performing the tensile test ten times, the number of times that the tensile test pieces were broken in an elastic region was 8 times and deterioration of the workability due to inclusions was recognized. The bending workability was insufficient.

In Comparative Example 9, the content of S was larger than the range of the invention of the present application (50 mass ppm or less). As a result of performing the tensile test ten times, the number of times that the tensile test pieces were broken in an elastic region was 8 times and deterioration of the workability due to inclusions was recognized. The bending workability was insufficient.

In Comparative Examples 10 and 11, the content of C was larger than the range of the invention of the present application (10 mass ppm or less). As a result of performing the tensile test ten times, the numbers of times that the tensile test pieces were broken in an elastic region were respectively 6 times and 7 times and deterioration of the workability due to inclusions was recognized. The bending workability was insufficient.

On the contrary, in the examples of the present invention, it was confirmed that the castability, the strength (0.2% proof stress), the conductivity, the stress relaxation resistance (residual stress ratio), and the bending workability were excellent. Further, as a result of performing the tensile test ten times, it was confirmed that the tensile test pieces were not broken in an elastic region and the workability was particularly excellent.

Based on the results obtained above, according to the examples of the present invention, it was confirmed that a copper alloy for electronic and electrical equipment and a copper alloy plate strip for electronic and electrical equipment with excellent conductivity, cold workability, bending workability, and castability can be provided.

INDUSTRIAL APPLICABILITY

Even in a case of being used for a member whose thickness was reduced along with miniaturization, it is possible to provide a copper alloy for electronic and electrical equipment, a copper alloy plate strip for electronic and electrical equipment, a component for electronic and electrical equipment, a terminal, a busbar, and a movable piece for a relay with excellent conductivity, cold workability, bending workability, and castability.

The invention claimed is:

1. A copper alloy for electronic and electrical equipment, comprising:

0.15 mass % or greater and less than 0.35 mass % of Mg;

0.0005 mass % or greater and less than 0.01 mass % of P; and a remainder which is formed of Cu and unavoidable impurities, wherein a conductivity is greater than 75% IACS, a content [Mg] (mass %) of Mg and a content [P] (mass %) of P satisfy relational expressions of $[Mg]+20\times[P]<0.42$ and $32\leq[Mg]/[P]\leq400$, a content of H is 10 mass ppm or less, a content of O is 100 mass ppm or less, a content of S is 50 mass ppm or less, and a content of C is 0.1 mass ppm or greater and 1 mass ppm or less, a 0.2% proof stress measured at the time of a tensile test performed in a direction orthogonal to a rolling direction is more than 320 MPa, and a residual stress ratio is more than 66% under conditions of 150° C. for 1000 hours.

2. The copper alloy for electronic and electrical equipment according to claim 1, wherein the content of H is 0.1 mass ppm or more and 4 mass ppm or less, the content of O is 0.1 mass ppm or more and 50 mass ppm or less, and the content of S is 1 mass ppm or more and 40 mass ppm or less.

3. The copper alloy for electronic and electrical equipment according to claim 1, wherein the content of H is 0.1 mass ppm or more and 2 mass ppm or less, the content of O is 0.1 mass ppm or more and 20 mass ppm or less, and the content of S is 1 mass ppm or more and 30 mass ppm or less.

4. A copper alloy plate strip for electronic and electrical equipment, comprising:

the copper alloy for electronic and electrical equipment according to claim 1.

5. The copper alloy plate strip for electronic and electrical equipment according to claim 4, wherein the copper alloy plate strip includes a Sn plating layer or a Ag plating layer on a surface of the copper alloy plate strip.

6. A component for electronic and electrical equipment, comprising:

the copper alloy plate strip for electronic and electrical equipment according to claim 4.

7. The component for electronic and electrical equipment according to claim 6, wherein the component includes a Sn plating layer or a Ag plating layer on a surface of the component.

8. A terminal, comprising:

the copper alloy plate strip for electronic and electrical equipment according to claim 4.

9. The terminal according to claim 8, wherein a surface of the terminal includes a Sn plating layer or a Ag plating layer on a surface of the terminal.

10. A busbar, comprising:

the copper alloy plate strip for electronic and electrical equipment according to claim 4.

11. The busbar according to claim 10, wherein the busbar includes a Sn plating layer or a Ag plating layer on a surface of the busbar.

12. A movable piece for a relay, comprising:

the copper alloy plate strip for electronic and electrical equipment according to claim 4.

13. The movable piece for a relay according to claim 12, wherein the movable piece includes a Sn plating layer or a Ag plating layer on a surface of the movable piece.

* * * * *